US008474912B2

(12) United States Patent
Lockwood et al.

(10) Patent No.: US 8,474,912 B2
(45) Date of Patent: Jul. 2, 2013

(54) SEATING ARRANGEMENT WITH SEAT AND BACK REST THAT ADJUST TOGETHER TO RECLINE

(75) Inventors: Dana Lockwood, Elkhart, IN (US); Joseph L. Waters, Goshen, IN (US); Cesar Antonio Santana, Elkhart, IN (US)

(73) Assignee: L & P Property Management Company, South Gate, CA (US)

( * ) Notice: Subject to any disclaimer, the term of this patent is extended or adjusted under 35 U.S.C. 154(b) by 335 days.

(21) Appl. No.: 12/904,729

(22) Filed: Oct. 14, 2010

(65) Prior Publication Data

US 2011/0084530 A1 Apr. 14, 2011

Related U.S. Application Data

(60) Provisional application No. 61/251,585, filed on Oct. 14, 2009.

(51) Int. Cl.
*A47C 1/024* (2006.01)

(52) U.S. Cl.
USPC ..... 297/342; 297/341; 297/343

(58) Field of Classification Search
USPC ..... 297/341, 342, 343
See application file for complete search history.

(56) References Cited

U.S. PATENT DOCUMENTS

| | | | | |
|---|---|---|---|---|
| 677,234 | A * | 6/1901 | Kelly | 297/343 |
| 1,789,337 | A * | 1/1931 | Knabusch et al. | 297/342 |
| 1,802,608 | A * | 4/1931 | Krause | 297/343 |
| 2,627,898 | A * | 2/1953 | Jackson | 297/342 |
| 5,660,439 | A * | 8/1997 | Unwalla | 297/316 |
| 7,185,951 | B2 * | 3/2007 | Johnson et al. | 297/343 |
| 7,611,202 | B2 * | 11/2009 | Johnson et al. | 297/343 |
| 7,780,230 | B2 * | 8/2010 | Serber | 297/216.15 |

* cited by examiner

*Primary Examiner* — Sarah B McPartlin
(74) *Attorney, Agent, or Firm* — Shook Hardy & Bacon LLP

(57) ABSTRACT

Subject matter described herein includes a seat assembly (e.g., chair, bench, sofa, vehicle seat, etc.) having a seat and a back rest that adjust together to facilitate reclining. The seat assembly includes a base coupled to a back-rest frame. The base remains substantially fixed relative to synchronized adjustment of the seat and the back rest, and the back-rest frame includes a pivot on which the back rest rotates to adjust a back-rest recline position. The assembly also includes the seat hingedly coupled to the back rest and a fore-and-aft adjuster that couples the seat to the base. A movement restrictor attaches to the seat and the base and biases the seat in a rearward orientation. The assembly further includes a pivot receiver coupled to the back rest, the pivot receiver providing a path along which the pivot travels when the seat moves forward and rearward.

20 Claims, 6 Drawing Sheets

SEATING ARRANGEMENT WITH SEAT AND BACK REST THAT ADJUST TOGETHER TO RECLINE

REFERENCE TO RELATED APPLICATIONS

This application is a nonprovisional application of U.S. 61/251,585, filed Oct. 14, 2009, which is fully incorporated herein by reference.

BACKGROUND

Various styles of seating arrangements allow a user to recline; however, recline mechanisms often require knobs, activation levers, or a combination thereof. Moreover, recline mechanisms often require user intervention (e.g., manual lever adjustment) before the seating arrangement is adjustable. As such, many reclining seating arrangements do not allow a user to recline by simply weighting and unweighting various parts of the arrangement.

SUMMARY

Subject matter described herein includes a seat assembly (e.g., chair, bench, sofa, vehicle seat, etc.) having a seat and a back rest that adjust together to facilitate reclining. The seat assembly includes a base coupled to a back-rest frame. The base remains substantially fixed relative to synchronized adjustment of the seat and the back rest, and the back-rest frame includes a pivot on which the back rest rotates to adjust a back-rest recline position. The assembly also includes the seat hingedly coupled to the back rest and a fore-and-aft adjuster that couples the seat to the base. A movement restrictor attaches to the seat and the base and biases the seat in a rearward orientation. The assembly further includes a pivot receiver coupled to the back rest, the pivot receiver providing a path along which the pivot travels when the seat moves forward and rearward.

A high-level overview of various aspects of the invention are provided in this summary for that reason, to provide an overview of the disclosure, and to introduce a selection of concepts that are further described in the detailed-description section below. This summary is not intended to identify key features or essential features of the claimed subject matter, nor is it intended to be used as an aid in isolation to determine the scope of the claimed subject matter.

BRIEF DESCRIPTION OF THE SEVERAL VIEWS OF THE DRAWINGS

Illustrative embodiments of the present invention are described in detail below with reference to the attached drawing figures, wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies.

Figure 1:
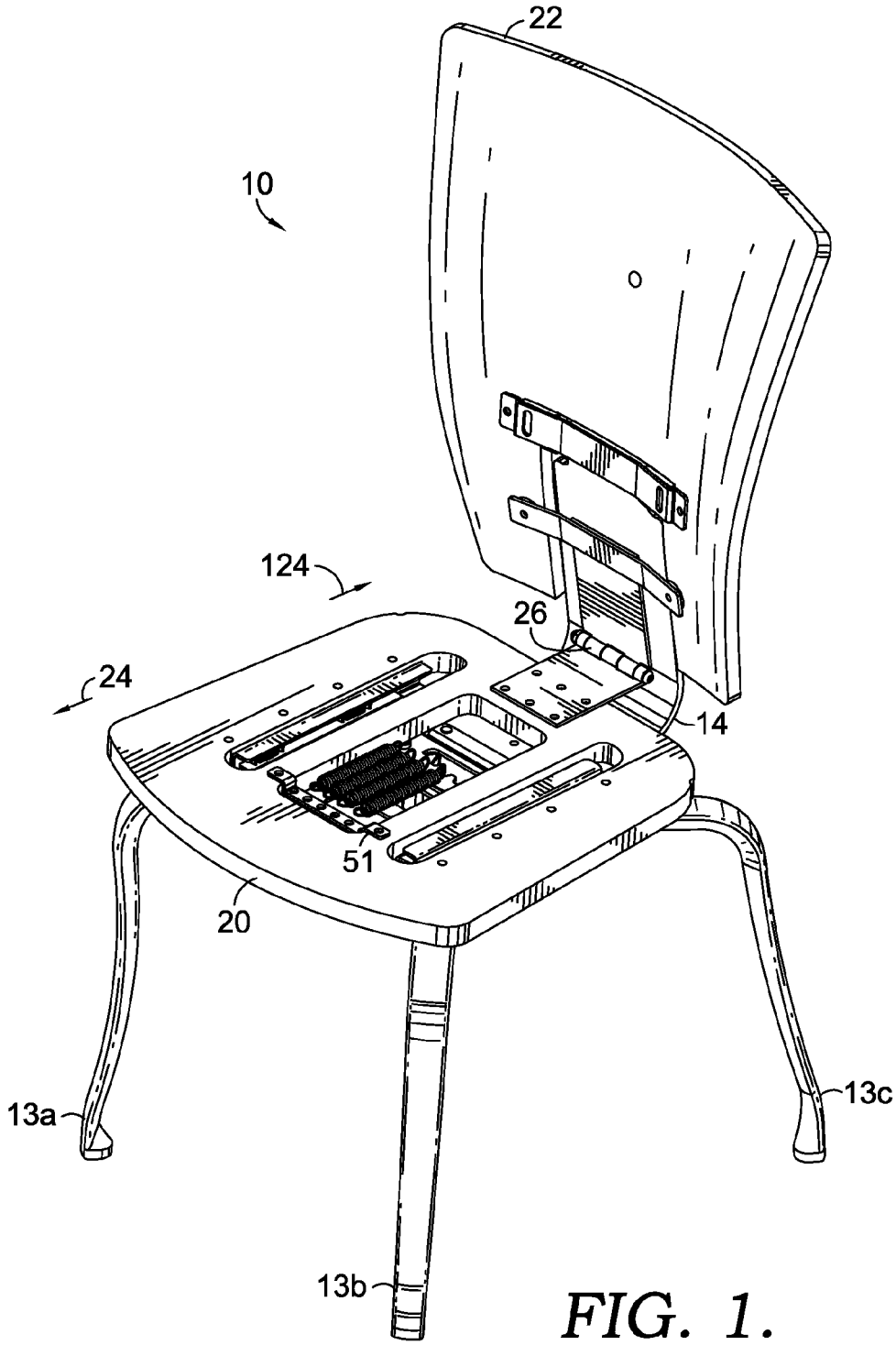
FIG. 1 depicts an elevated perspective view of a seating arrangement in accordance with an embodiment of the present invention.

As is known, a seating arrangement (e.g., chair, bench, sofa, vehicle or craft seat, etc.) is typically equipped with a base, which supports the seating arrangement on a ground surface or floor. An exemplary base includes legs 13*a-c* that are depicted in FIG. 1; however, a base might include any of a variety of other components that function to support the seating arrangement. A base might also include arm supports. Usually, a base remains fixed relative to movement or adjustment of other components of the seating arrangement. In addition, a base serves as a foundation onto which other seating-arrangement components are attached. For example, a seat chassis and a back-rest frame might be coupled to the base.

Referring to FIG. 1, an embodiment of a seating arrangement 10 includes a base (e.g., including legs 13*a-c*) coupled to a back-rest frame 14, both of which remain stationary relative to an adjustment of a seat 20 and a back rest 22. As will be described in more detail below, seat 20 and back rest 22 are hingedly connected (such as by hinge 26), such that, when seat 20 slides forward (as depicted by arrow 24), back rest 22 pivots to recline and adjusts downward. Conversely, when seat 20 slides rearward (as depicted by arrow 124), back rest 22 pivots to a less reclined position and adjusts upward.

Figure 2:
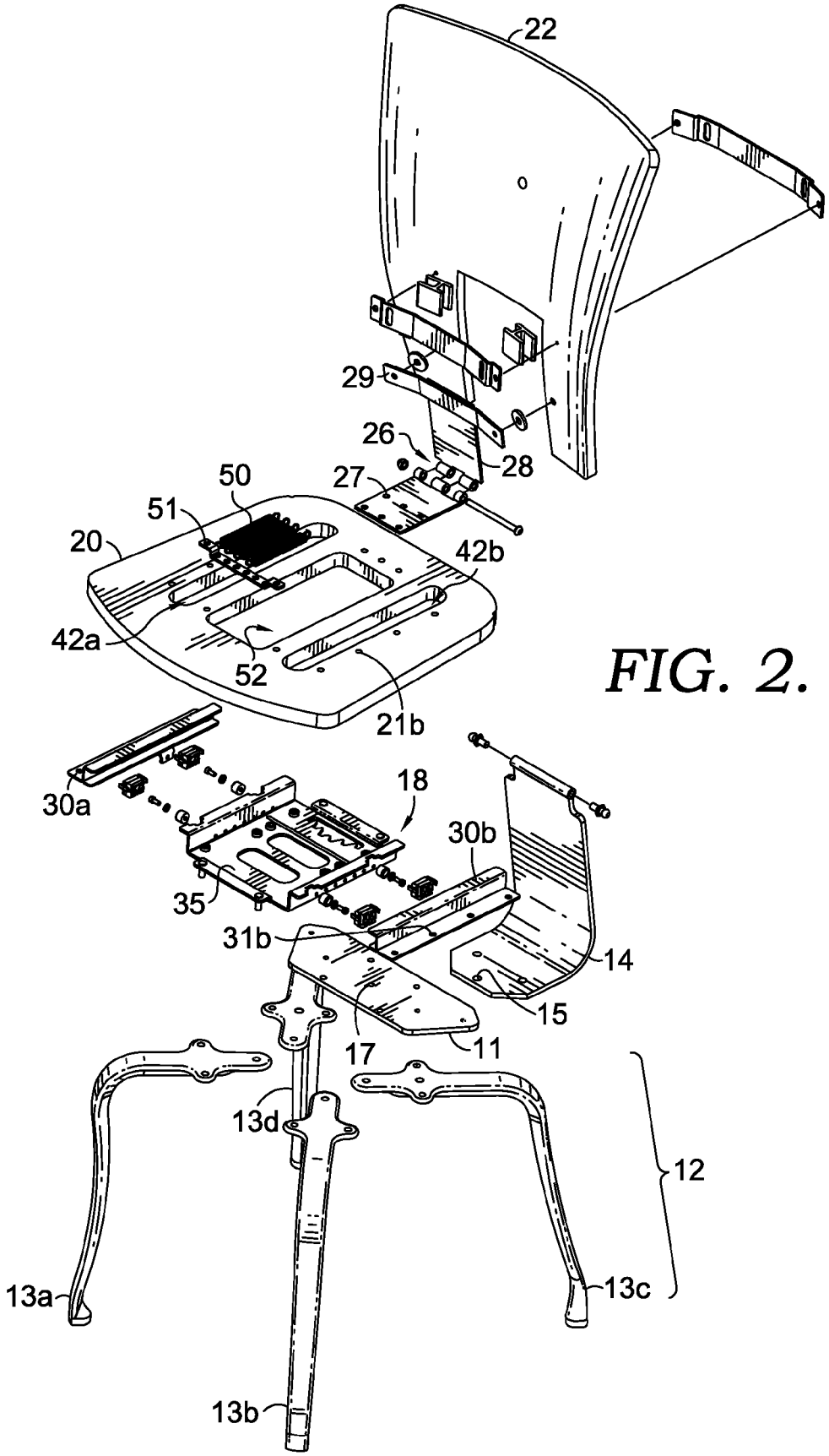
FIG. 2 depicts and exploded view of the seating arrangement of FIG. 1 in accordance with an embodiment of the present invention.
Figure 6C:
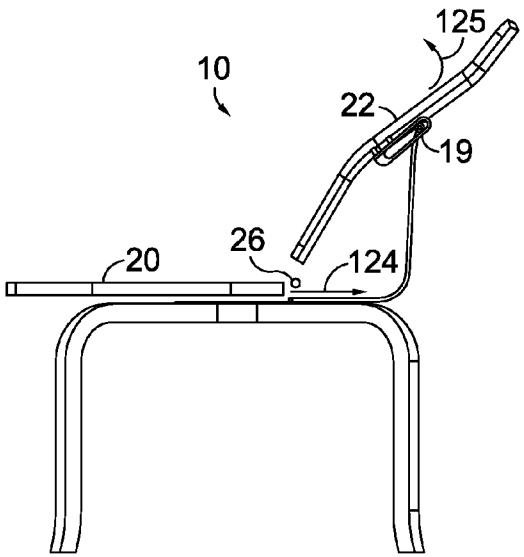
FIGS. 6A-6C each depict a side view of a respective seating arrangement in accordance with an embodiment of the present invention.
Figure 6B:
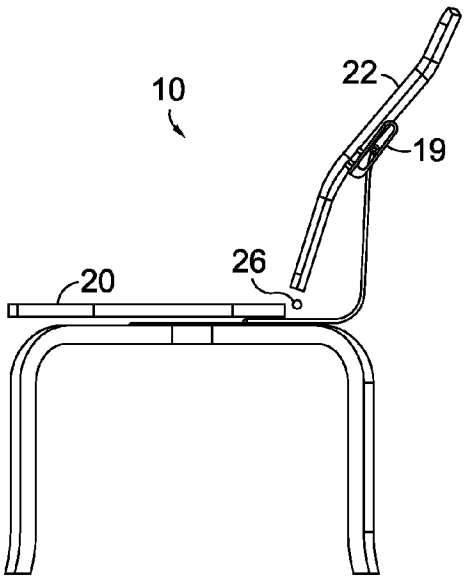
Figure 6A:
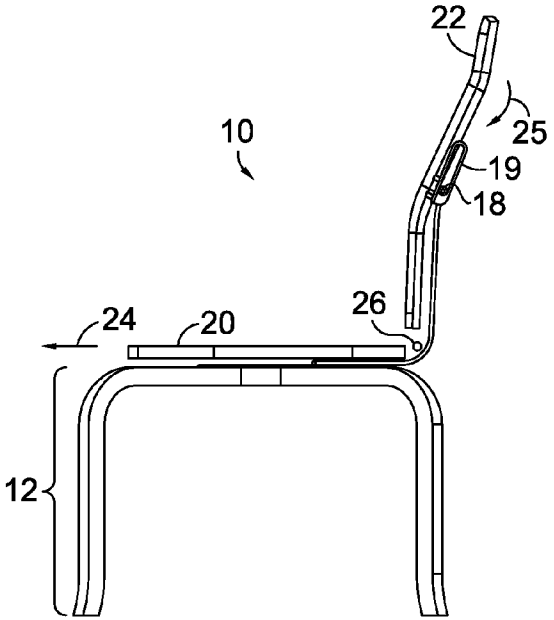

Referring to FIGS. 6A-6C, an alternative embodiment of a seating arrangement is depicted, and FIGS. 6A-6C depict a progression of adjustments that might be made to the seat 20 and the back rest 22. Although the respective seating arrangements depicted in FIGS. 1 and 2 are different than the seating arrangements depicted in FIGS. 6A-6C, the same progression of seat and back-rest movement is applicable to the seating arrangements depicted in all of FIGS. 1, 2, and 6A-6C. For example, seat 20 and back rest 22 are hingedly connected by hinge 26, and in FIG. 6A, seat 20 is in a rearward orientation (relative to base 12). As between FIG. 6A and FIG. 6B, the seat 20 has moved forward in the direction of arrow 24 and a corresponding movement of the back rest 22 is affected in the direction of arrow 25. Arrow 25 depicts that the back rest 22 both reclines and moves generally downward in response to a movement of the seat 20 in the direction of arrow 24. Movement of the seat 20 and the back rest 22 might be caused by exerting a force on the seat, by exerting a force on the back rest 22 above pivot 18, or by a combination thereof.

Movement of the seat 20 and the seat back 22 might also take place in a direction that is opposite to the respective directions indicated by arrows 24 and 25. For example, FIG. 6C depicts that, when the seating arrangement 10 is in a reclined position, the seat 20 might be adjust backward (i.e., aft), as indicated by arrow 124. Further, FIG. 6C depicts that, when the seating arrangement 10 is in a reclined position, the back rest 22 might be adjusted to reduce the recline and generally upward, as indicated by arrow 125. Movement of the seat 20 and the back rest 22 might be caused by exerting a force on the seat in the direction of arrow 124. For example, a spring might be coupled to the seat 20 that biases the seat 20 in a rearward orientation (relative to the base 12).

Referring to FIGS. 1 and 6A-6C, the seating arrangement 10 might also be provided with a pair of arm rests (not depicted). Although the seating arrangement 10 illustrated in various figures includes an office-type chair, embodiments of the present invention include use with a variety of seating types. For example, the present invention might also be applied to other types of chairs and home seating, e.g., bench, recliner, couch, sofa, etc. Moreover the present invention might be applied to various types of seating used in transit, such as in an airplane, boat or other marine vessel, automobile, bus, train, etc. The present invention might also be used in other applications, such as casino seating, airport seating, and hospitality seating. In addition, seating arrangement 10 depicts internal structural components, such that in other embodiments, seating arrangement 10 might include additional cushioning and upholstery (now shown).

Referring now to FIGS. 1 and 2, the base 12 and the back-rest frame 14 support the seat 20 and the back rest 22, which are hingedly connected to one another. Base 12 includes a combination of legs 13*a-d* and any other mounting structures onto which other seating-arrangement components are mounted. For example, base 12 includes plate 11 (FIG. 2), which is a mounting structure onto which the back-rest frame 14 mounts. In one embodiment, the back-rest frame 14 attaches to base 12 or to plate 11. For example, the back-rest frame 14 includes holes 15 that align with holes 17 of plate 11, such that the back-rest frame 14 and the plate 11 can be coupled using fasteners that are fixed in the aligned holes. The back-rest frame 14 might alternatively extend from other portions of the base 12, such as from arm supports (not shown). The back-rest frame 14 includes a portion that extends away from base 12 and that supports back rest 22. Support of the back rest 22 by the back-rest frame 14 will be described in more detail below.

An embodiment of the present invention includes a fore-and-aft adjuster 18 that couples the seat 20 to the base 12 and that enables the seat 20 to move forward and rearward relative to the base 12. For example, the fore-and-aft adjuster 18 enables the seat 20 to slide in the direction of arrow 24 and arrow 124. The terms "slide" and "sliding" as used herein generally describe a movement of a first component (e.g., the seat 20 or the user back rest 22) relative to a second component (e.g., the base 12 or the back-rest frame 14). As such, sliding might refer to any two components or objects that move past one another.

In an embodiment of the invention, the fore-and-aft adjuster 18 that enables the seat 20 to slide forward and backward is positioned between the seat 20 and the base 12. For example, the fore-and-aft adjuster 18 might be positioned directly beneath the seat 20. A larger depiction of the fore-and-aft adjuster 18 is provided in FIG. 5. The fore-and-aft adjuster 18 includes a seat chassis 35 that securely attaches to the base 12. For example, the chassis 35 includes holes that are aligned with holes on a top portion of the legs 13*a-d*, and a fastener (not shown) is secured in the aligned holes. In addition, the fore-and-aft adjuster 18 includes slide assemblies 36*a-b* that fixedly attach to the seat chassis 35. For example, slide assembly 36*a* includes slide bearing 37*a* that mates with recess 38*a* of the seat chassis 35. Slide assembly 36*a* also includes a bumper 39*a* attached both to a drive 40*a* and between the slide bearing 37*a* and the seat chassis 35. For exemplary purposes, FIGS. 2 and 5 depict a set of four slide assemblies; however, other embodiments might include either more than four slide assemblies or less than four slide assemblies.

The fore-and-aft adjuster 18 also includes rails 30*a* and 30*b* that are fixedly attached to the seat 20 and that slidably engage the slide bearings (e.g., 37*a-b*). For example, the rail 30*b* might attach to the seat 20 by securing a fastener through holes 31*b* of the rail 30*b* that are aligned with holes 21*b* of the seat 20. In addition, slide bearing 37*a* fits in a channel 41*a* of rail 30*a*, and slide bearing 37*b* fits in a channel 41*b* of rail 30*b*. Because rails 30*a* and 30*b* are fixedly attached to the seat 20, when rails 30*a* and 30*b* slide relative to slide bearings (e.g., 37*a-b*), the seat 20 adjusts forward and rearward relative to the seat chassis 35 and the base 12. Although not depicted, an embodiment includes stops that selectably engage the rails 30*a* and 30*b* to prevent movement. For example, a user-activated knob or lever might be positioned under the seat 20, such that when the knob or lever is activated by a user, the rails 30*a* and 30*b* are locked into place so as to prevent adjustment of the seat 20.

In one embodiment, so as to conceal the rails 30*a* and 30*b*, the seat 20 includes cutouts or recesses 42 into which the rails 30*a* and 30*b* are positioned. Alternatively, the rails 30*a* and 30*b* could be exposed when fixed to an underneath side of the seat. In another embodiment of the present invention, stops might be positioned on the seat chassis 35 to engage the rails 30*a* and 30*b* so as to provide a starting and stopping point of a sliding motion of the seat 20.

Figure 5:
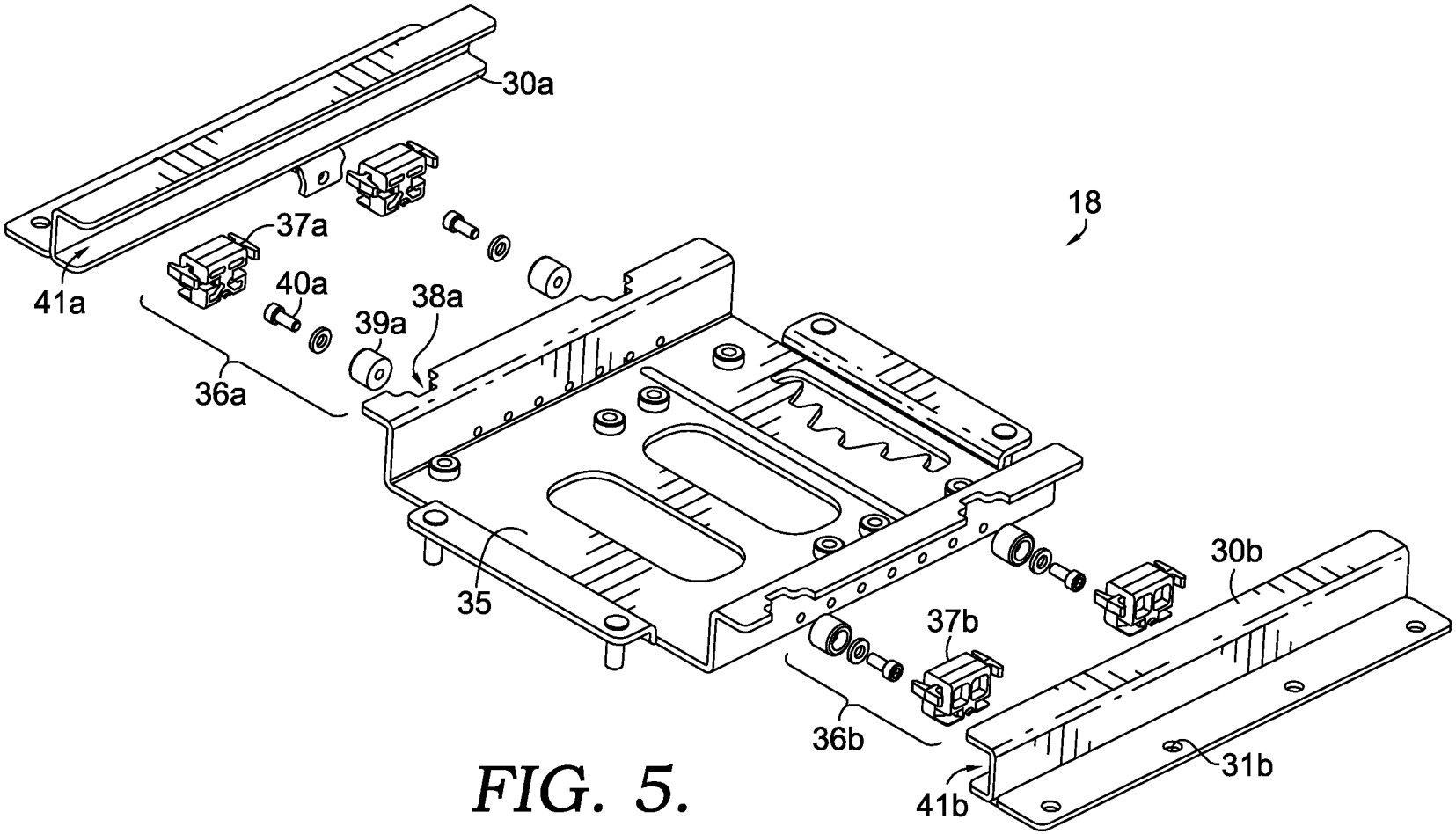
FIG. 5 depicts an exploded perspective view of a fore-and-aft adjuster in accordance with an embodiment of the present invention.

Other fore-and-aft adjusters might include various alternative configurations that perform the functions of the components described in FIGS. 2 and 5. For example, slides might be positioned on the sides of the seat 20 (i.e., the left side and the right side). In addition, the sliding mechanism might include a roller that slides on a track. For example, a roller that is fixed to an underneath side of the seat 20 might slide along a track that is fixed to the seat chassis 38. Moreover, the sliding mechanism might include any seat slider used in seating-arrangement-related technology, such as a seat slider used to slide a seat in an automobile. Furthermore, the sliding mechanism might be a more generic type of slide, such as a drawer slide. In a further embodiment, the slide mechanism includes two plastic plates having complementary portions that mate and that slide into one another. In an alternative embodiment, components of a fore-and-aft adjuster might switch relative to those components of FIG. 5, such that seat chassis 35 attaches to an underneath side of the seat 20 and the rails 30*a* and 30*b* attach to the base 12. Again, these are merely examples of alternative versions of fore-and-aft adjusters that make up different embodiments of the present invention.

Another embodiment of the present invention includes a movement restrictor that attaches to the seat 20 and that biases the seat 20 in a rearward orientation when attached to the base 12. For example, FIG. 2 depicts a tension spring 50 that attaches on top of the seat 20 to a spring bracket 51. The tension spring 50 extends through a middle recess 52 of the seat 20 and attaches to the seat chassis 38 or another portion of the base 12. Accordingly, when the seat 20 adjusts forward in the direction of arrow 24, tension spring 50 tightens to provide an opposing force against the forward motion and in the direction of arrow 124. The opposing force in the direction of arrow 124 biases the seat 20 in a rearward orientation. Although in FIG. 2 the spring 50 is coupled on top of the seat 20, in other embodiments, the spring might be coupled to any portion of the seat 20, such as to an underneath side of the seat 20 or to the rails 30*a* and 30*b*. In addition, although a tension spring is depicted in FIG. 2, any other tension-providing mechanism might alternatively be utilized.

FIG. 2 also depicts a hinge 26 that couples the seat 20 to the back rest 22. The hinge 26 includes a simple hinge that joins a seat hinge plate 27 and a back-rest hinge plate 28. The seat hinge plate 27 is secured to the seat 20, such as by fasteners secured through holes. The back-rest hinge plate 28 is secured to the back rest 22 by a similar means, and FIG. 2 depicts a hinge-plate extension 29, which allows the back-rest hinge plate 28 to be positioned in a back-rest cutout and secured to the back rest 22. When referring to FIGS. 6A-6C it should be understood that the item identified by reference numeral 26 represents a hinge. While hinge 26 is depicted a relatively simple style of hinge, in other embodiments, hinge 26 might include a more complex design having tension qualities that bias the seat 20 and the back rest 22 in a desired orientation.

Hinge 26 couples the seat 20 to the back rest 22, such that any movement (e.g., sliding) of the seat 20 forward or backward triggers a complementary movement of the back rest 22. Likewise, moving the back rest 22 triggers a movement (via the hinge 26) to the seat 20. As previously described with reference to FIGS. 6A-6C, arrow 24 coincides with arrow 25, and indicates that the back rest 22 is movable along a depicted path, such as when the seat 20 is moved in a forward direction. Also, arrow 124 coincides with arrow 125 and indicates that the back rest 22 is movable along a depicted path, such as when the seat 20 is moved in a rearward direction indicated by arrow 124.

Figure 3:
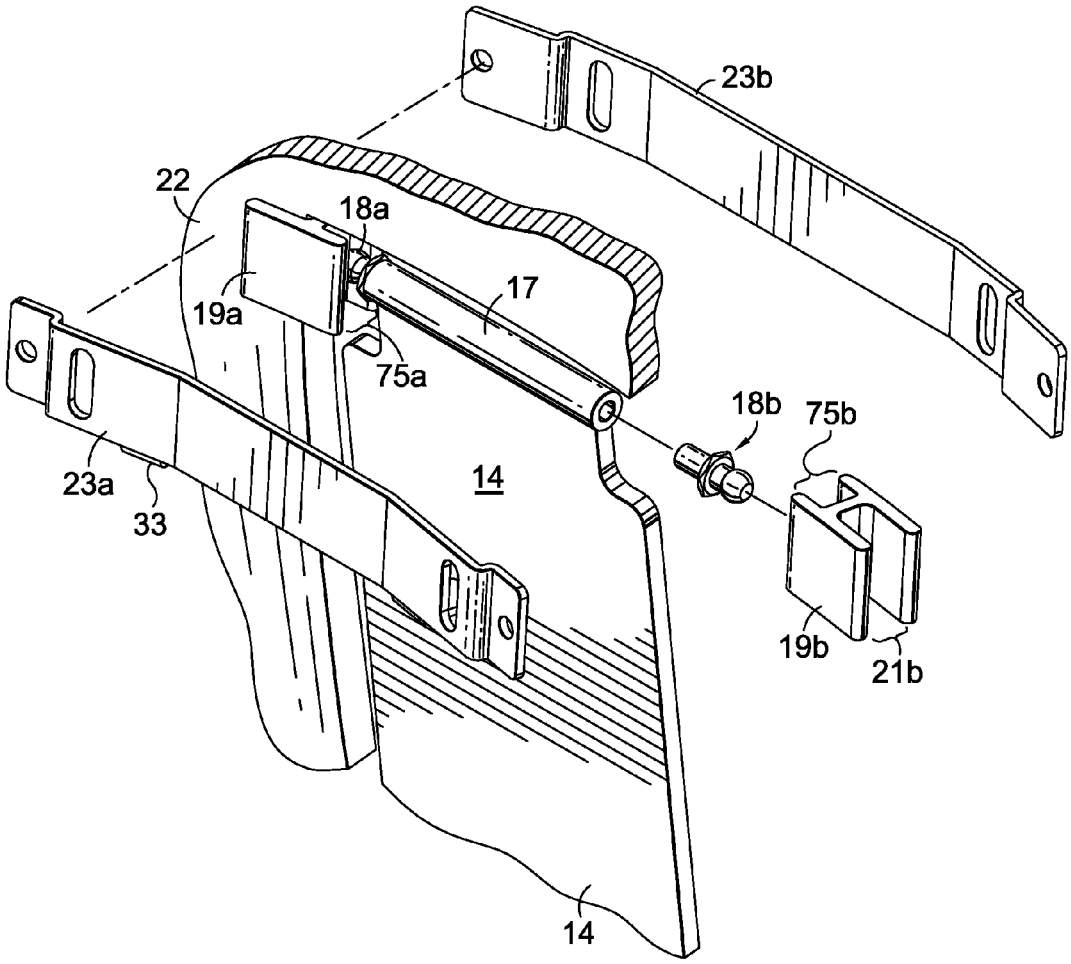
FIG. 3 depicts a perspective view of a portion of a back-rest frame and a back rest in accordance with an embodiment of the present invention.

Referring to FIGS. 2 and 3, as briefly described above, the back rest 22 is supported by the back-rest frame 14. FIG. 3 depicts a larger view of how the back-rest frame 14 is coupled to the back rest 22. For example, the back-rest frame 14 includes a pivot sheath 17 that houses pivots 18*a* and 18*b*. Pivot 18*a* and 18*b* might include various types of pivots and a ball stud is depicted in FIG. 3. A ball stud includes a stud portion that fits into pivot sheath 17 and a ball portion on which another component pivots. However, in other embodiments, pivot 18*a* and 18*b* might include a roller, or other type of pivot that allows back rest 22 to rotate to adjust a back-rest recline position.

FIG. 3 depicts pivot receivers 19*a* and 19*b*. Pivot receiver 19*a* is coupled to the back rest 22, and pivot 18*a* is coupled with pivot receiver 19*a*. Although FIG. 3 depicts the pivot receivers 19*a* and 19*b* coupled within a cutout of the back rest 22, the pivot receivers 19*a* and 19*b* might be positioned on a back side of the back rest 22, such as a pivot receiver 19 depicted in FIGS. 6A-6C. The pivot receiver 19*a* includes a channel that mates with, and allows the pivot receiver 19*a* to fit onto, back rest 22. A channel 21*b* that mates with the back rest 22 is better depicted with respect to the pivot receiver 19*b*, since the pivot receiver 19*b* is shown unattached to the back rest 22. In addition, brackets 23*a* and 23*b* attach to the back rest 22 and encase the pivot receivers 19*a* and 19*b* to hold the pivot receivers 19*a* and 19*b* in position.

The pivot receivers 19*a* and 19*b* further include a pivot-receiver channel 75*a* and 75*b* and pivot 18*a* is positioned in the pivot-receiver channel 275*a* of the pivot receiver 19*a*. The pivot 18*a* is slidably positioned in the channel 75*a*, such that the pivot receiver 19*a* (and the back rest 22) can slide up and down relative to the pivot 18*a*. Moreover, the pivot receiver 19*a* (and the back rest 22) can rotate on the ball portion of the pivot 18*a*, such as when a back-rest recline position is being adjusted.

Figure 4A:
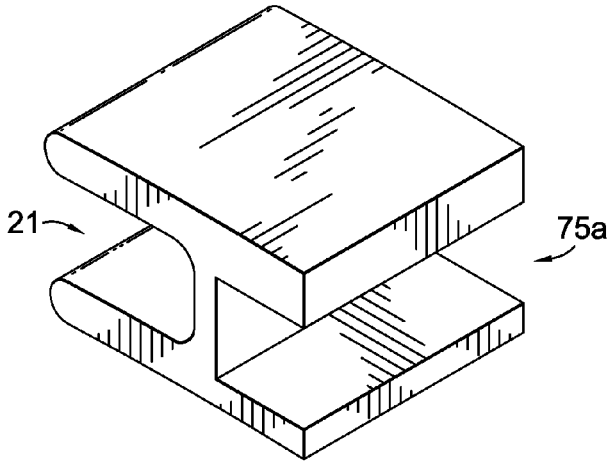
FIGS. 4A and 4C depict a respective pivot receiver in accordance with an embodiment of the present invention.
Figure 4B:
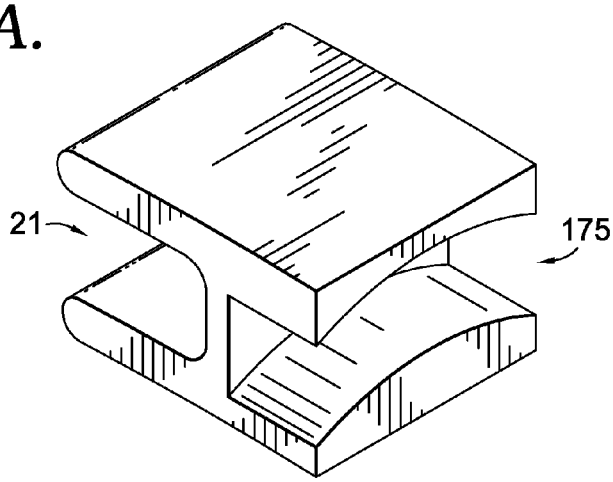
Figure 4C:
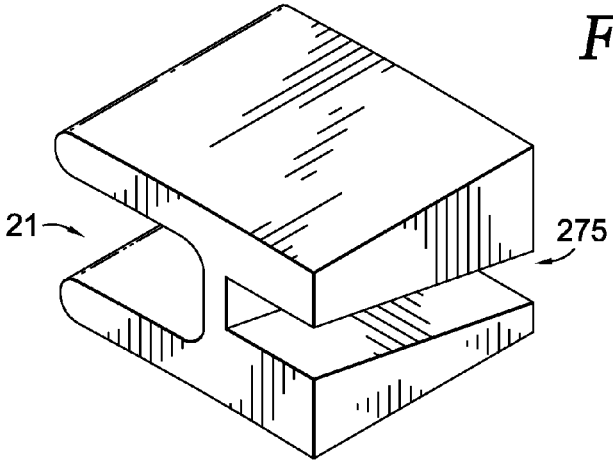

In an embodiment of the present invention, the channel 75*a* allows a path of the back rest 22 to be predetermined, controlled, and customized when the back rest 22 is moving in the direction indicated by arrow 25 (FIG. 6A). For example, the channel 75*a* depicted in FIG. 3 is straight and in a substantially same plane as the back rest 22. The channel 75*a* is also depicted in FIG. 4A. However, other pivot-receiver channels might be configured alternatively to the channel 75*a*. For example, FIG. 4B depicts a channel 175 that includes an arc, thereby providing a path of the back rest 22 that would follow a more semi-circular trajectory. In another example, FIG. 4C depicts a channel 275 that is angled relative to a plane of the back rest 22, as evidence by the channel 21 that mates with, and allows the pivot receiver to fit onto, back rest 22. Moreover, FIGS. 6A-C depict a pivot-receiver channel that might be longer than channel 75*a*, thereby enabling a larger back-rest recline angle. As such, a pivot-receiver channel (e.g., 75*a*, 175, or 275) can be designed to enable the back rest 22 to recline to either a greater or lesser extent when the back rest 22 is moved together with the seat 20. Essentially, a pivot-receiver channel configurable to affect any desired path of the user back rest 22.

In another embodiment, seating assembly 10 includes stops that limit a movement of pivot 18*a* or 18*b* in channel 75*a*. For example, as depicted in FIG. 3, bracket 23*a* includes stop 33 that, when bracket 23*a* is fixed onto back rest 22, is positioned directly beneath pivot receiver 19*a* and directly in a path of channel 75*a*. That is, stop 33 includes a tab that extends substantially perpendicular from bracket 23*a*. Accordingly, when stop 33 is positioned in the path of channel 75*a*, stop 33 limits a movement of pivot 18*a*, such as when back rest 22 is moving in a direction depicted by arrow 125 (FIG. 6C).

While FIGS. 6A-6C show the seat 20 sliding in a same plane (which is substantially parallel to the seat chassis 35), in an alternative embodiment, the seat 20 might be caused to slide outside its starting plane in a non-parallel predetermined path. For example (similar to the pivots 18*a*-*b* and the pivot-receiver 19*a*-*b* that determine a trajectory of a movement of the back rest 22), another pivot and pivot receiver might be used to control a trajectory of the seat's adjustment forward and rearward. Essentially, the sliding path of the seat 20 can be predetermined to be inside or outside the same plane as the seat 20 in a starting position by configuring a mating relationship of the sliding mechanism.

In embodiments of the present invention, a pivot receiver is designed with a channel, which allows a pivot to travel along a predetermined path. The channel is designed so that the pivot moves along the predetermined path without restriction. This movement along the path is initiated when pressure (e.g., weight) is applied by pushing on an upper portion of the seat back (e.g., when a user leans back), by pulling and pushing on the seat 20 (e.g., when a user scoots his or her hips forward), or by a combination thereof. That is, when back activated, a user leans backward into the seat back 22, which operatively "pushes" the seat 20 forward through its sliding motion and forces the seat back 22 to move generally downward and to recline. The trajectory of the general downward motion and reclining motion is controlled by an interaction of the pivot and the pivot receiver. In embodiments of the present invention, the reclining motion of the user back rest 22 is customizable by modifying a channel of the pivot receiver.

Although FIGS. 1, 2, 3, and 6A-6C depict a pivot coupled to a back-rest frame and a pivot receiver coupled to a back rest, in other embodiments, the pivot and pivot receiver might be positioned at other locations of the seat assembly. For example, the pivot might be positioned on the back rest, on the seat, or on the seat chassis. Likewise, the pivot receiver might be positioned on the back-rest frame, on the seat chassis, or on the seat. Moreover, although the fore-and-aft adjuster is positioned between the seat and base, a sliding mechanism might alternatively be positioned behind the back rest.

Embodiments of the present invention provide a design that allows control over a back recline without the use of handles, knobs, activation levers and handles, and without a significant amount of user intervention. The recline or incline movement is controlled by weighting and unweighting the seat 20, the user back rest 22, or a combination of both. Moreover, embodiments of the present invention enable chair components, such as a seat and a user back rest, to trace a shape of a user as the user reclines or inclines in the chair.

Embodiments of the present invention might include an assembled seating arrangement, such as a chair. Other embodiments of the invention might include a kit, that is an accessory to other seat-assembly components and that enable the other seat-assembly components to adjust in a manner described herein.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A seat assembly that is attachable to a base and that facilitates reclining, the assembly including:

a back-rest frame that attaches to the base, wherein the back-rest frame includes a pivot on which a back rest rotates to a adjust a back-rest recline position;

a fore-and-aft adjuster that couples a seat to the base and that enables the seat to move forward and rearward relative to the base;

a movement restrictor that attaches to the seat and that biases the seat in a rearward orientation when attached to the base;

a hinge that couples the seat to the back rest; and a pivot receiver comprising a backrest-mating channel and a pivot-receiver channel, wherein the pivot is slidably positioned in the pivot-receiver channel, and wherein the back rest is received in the backrest-mating channel when the pivot receiver is coupled to the backrest.

2. The assembly of claim 1, wherein the pivot includes a roller.

3. The assembly of claim 1, wherein the pivot includes a ball stud.

4. The assembly of claim 1, wherein the fore-and-aft adjuster includes:

a rail that securely attaches to the seat;

a slide assembly that slidably communicates with the rail; and a seat chassis that is fixedly attached to the slide assembly and that attaches to the base.

5. The assembly of claim 1, wherein the movement restrictor includes a spring.

6. The assembly of claim 1, wherein the pivot-receiver channel is substantially straight.

7. The assembly of claim 1, wherein the pivot-receiver channel includes an arc that dictates a path in which the pivot travels when the back-rest recline position is being adjusted.

8. A seat assembly having a seat and a back rest that adjust together to facilitate reclining, the seat assembly comprising:

a base coupled to a back-rest frame, wherein the base remains substantially fixed relative to synchronized adjustment of the seat and the back rest, and wherein the back-rest frame includes a pivot on which the back rest rotates to adjust a back-rest recline position;

the seat hingedly coupled to the back rest;

a fore-and-aft adjuster that couples the seat to the base and that enables the seat to move forward and rearward relative to the base;

a movement restrictor attached to the seat and the base that biases the seat in a rearward orientation; and a pivot receiver coupled to the back rest, wherein the pivot receiver includes a pivot-receiver channel, wherein the pivot is slidably coupled in the pivot-receiver channel, and wherein the pivot receiver includes a backrest-mating channel, the back rest being secured in the backrest-mating channel.

9. The seat assembly of claim 8, wherein the back-rest frame includes a first portion that is attached to the base; and wherein the back-rest frame includes a second portion that extends from the first portion and that includes a pivot sheath, which houses the pivot.

10. The seat assembly of claim 9, wherein the pivot includes a ball stud having a post positioned in the pivot sheath.

11. The seat assembly of claim 9, wherein the ball stud includes a ball that is slidably coupled in the pivot-receiver channel and that travels along the path.

12. The seat assembly of claim 9, wherein the pivot includes a roller having an axle positioned in the pivot sheath.

13. The seat assembly of claim 8, wherein the pivot-receiver channel includes a substantially straight configuration.

14. The seat assembly of claim 8, wherein the pivot-receiver channel includes a curved configuration and the back-rest-mating channel includes a substantially straight configuration.

15. The seat assembly of claim 8 further comprising, a hinge that couples the seat to the back-rest.

16. The assembly of claim 8, wherein the fore-and-aft adjuster includes:

a rail that securely attaches to the seat;

a slide assembly that slidably communicates with the rail; and a seat chassis that is fixedly attached to the slide assembly and that attaches to the base.

17. The assembly of claim 8, wherein the movement restrictor includes a tension spring.

18. A seat assembly having a seat and a back rest that adjust together to facilitate reclining, the seat assembly comprising:

a base that is coupled to the seat and that remains substantially fixed relative to synchronized adjustment of the seat and the back rest;

a back-rest frame that is attached to the base and that includes a pivot on which the back rest rotates to a adjust a back-rest recline position;

the seat hingedly coupled to the back rest;

a fore-and-aft adjuster that couples the seat to the base;

a spring attached to the seat and the base that biases the seat in a rearward orientation;

a pivot receiver coupled to the back rest, wherein the pivot receiver includes a pivot-receiver channel that slidably communicates with the pivot, and wherein the pivot receiver includes a backrest-mating channel, the back rest being secured in the backrest-mating channel; and a first bracket that attaches to a first side of the pivot receiver and a first side of the backrest and a second bracket that attaches to a second side of the pivot receiver and a second side of the backrest, wherein the first bracket and the second bracket at least partially encase the pivot receiver.

19. The assembly of claim 18, wherein the first bracket includes a stop that is positioned at an end of the pivot-receiver channel when the first bracket is attached to the first side.

20. The assembly of claim 18, wherein a path provided by the pivot-receiver channel controls the back-rest recline position.

* * * * *